US005549926A

United States Patent [19]

Miyamoto

[11] Patent Number: 5,549,926

[45] Date of Patent: Aug. 27, 1996

[54] MANUFACTURING METHOD OF ELECTRONIC PART

[75] Inventor: Makoto Miyamoto, Nagaokakyo, Japan

[73] Assignee: Murata Manufacturing Co., Ltd., Japan

[21] Appl. No.: 550,221

[22] Filed: Oct. 30, 1995

Related U.S. Application Data

[63] Continuation of Ser. No. 248,861, May 24, 1994, abandoned.

[30] Foreign Application Priority Data

May 31, 1993 [JP] Japan ..... 5-154134

[51] Int. Cl.[6] ..... B05D 5/12

[52] U.S. Cl. ..... 427/100; 427/336; 427/410; 427/431; 427/434.3; 29/25.35; 310/340; 310/367; 174/52.2; 257/790

[58] Field of Search ..... 427/58, 79, 100, 427/103, 336, 410, 416, 402, 430.1, 431, 434.3; 29/25.35; 310/311, 340, 367; 174/52.1–52.4; 361/820, 813; 257/787, 788, 790

[56] References Cited

U.S. PATENT DOCUMENTS

| | | | |
|---|---|---|---|
| 3,747,176 | 7/1973 | Toyoshima | 29/25.35 |
| 4,017,752 | 4/1977 | Kakehi et al. | 310/9.4 |
| 4,992,693 | 2/1991 | Kishi et al. | 310/348 |
| 5,045,354 | 9/1991 | Fetmer et al. | 427/245 |
| 5,331,504 | 7/1994 | Kamiya et al. | 361/301.1 |

FOREIGN PATENT DOCUMENTS 393708 of 1989 Japan .

*Primary Examiner*—Shrive P. Beck
*Assistant Examiner*—Brian K. Talbert
*Attorney, Agent, or Firm*—Ostrolenk, Faber, Gerb & Soffen, LLP

[57] ABSTRACT

A method of manufacturing an electronic part includes a step of preparing a molten resin bathtub used for coating the outer surface of the electronic part. On a surface of the resin in the molten resin bathtub, a layer of a surface-active agent is formed. The electronic part body is dipped via the solvent layer into the molten resin bathtub. After coating the electronic part body with the molten resin, the electronic part body is removed from the molten resin bathtub. The molten resin is cured by heating and the resin layer is formed on the electronic part body.

12 Claims, 4 Drawing Sheets

MANUFACTURING METHOD OF ELECTRONIC PART

This is a continuation of application Ser. No. 08/248,861, filed on May 24, 1994, now abandoned.

BACKGROUND OF THE INVENTION

1. Field of the Invention

This invention relates to a method of manufacturing an electronic part and, more particularly, to a method of manufacturing an electronic part provided with resin layers formed on a periphery of the electronic part, the resin layers being formed by dipping the electronic part into resin.

2. Description of the Prior Art

In a method of cleaning an electronic part, an enviromentally safe use of cleaning method such as a cleaning method using water is planned for abolishing use of an ozone layer damaging material and an environmentally pollutive material such as a freon, trichloroethane and the like. As one conventional example of an electronic part capable of being cleaned with water, an electronic part having a multilayer structure of a resin outer coat is shown in FIG. 5(*a*) and FIG. 5(*b*).

As shown in FIG. 5(*a*) and FIG. 5(*b*), a piezoelectric resonator 1 is one example of the electronic part. The piezoelectric resonator is comprised of a strip-shaped resonator element 2 constituting an electronic part body, a pair of terminals 3, 3 which hold the element by pinching it at both ends and are connected to electrodes of the element, a first resin layer 4 and a second resin layer 5. A cavity 6 is formed to prevent impairing vibration of a vibrating portion having vibration electrodes. As shown in FIG. 4, the resonator element 2 is provided with vibration electrodes 8, 8 disposed opposite to each other on two opposing surfaces of a piezoelectric substrate 7.

Manufacture of the above piezoelectric resonator 1 is performed as described below. After holding the resonator element 2 by pinching it at both ends with the pair of terminals 3, 3, the terminals are connected and bonded to the electrodes. The first resin layer 4 is formed by coating the surfaces of the electrodes 8, 8 on the piezoelectric substrate 7 with wax 9, thereafter as shown in FIG. 6(*a*), the surfaces of the piezoelectric resonator element 2 are coated with resin by dipping them into a resin bathtub, leaving the end portions of the terminals 3 uncoated. Furthermore, as shown in FIG. 6(*b*), the second resin layer 5 is formed on the surface of the first resin layer 4 by dipping the coated element into a second resin bathtub, thus the outer coat is formed in multilayers and set by heat. In addition, when necessary, as shown in FIG. 6(*c*), a final resin layer 10 is formed on the surface of the second resin layer 5 by dipping the coated element into a final resin bathtub and is set by heat, thereby to produce a dense layer on the surface and increase strength of the layer. By heat-setting the resin of the first resin layer 4, the wax is melted and diffused into the resin, so that a cavity is formed for vibration in the vibrating portion.

However, in the above conventional manufacturing method of an electronic part, there is a problem that when dipping the element into the resin, an area of the element covered by the resin becomes less in an upper portion of the element. That is, the amount of resin is less near the roots of the terminals 3 of the electronic part. Thus, gaps are generated near the roots of the terminals, thereby allowing water to invade. Particularly, when the number of times an element is dipped increases, the resin surrounding the upper portion of the element becomes worse as the number of dipping times increases.

SUMMARY OF THE INVENTION

An object of the present invention is to overcome the problems of the above conventional technology, by providing a method of manufacturing an electronic part that can improve reliability of the part by improving the resin surrounding the terminal roots of the electronic part and improving watertightness and further improving the strength of the part.

The present invention relates to a method of manufacturing an electronic part provided with resin layers on a periphery of electronic part body, and the manufacturing method includes the steps of forming the electronic part body, forming a surface active agent layer on a surface of resin in a molten resin bathtub, dipping the electronic part body into the molten resin bathtub via the surface active agent layer, and a step of pulling up the electronic part body after coating the electronic part body with the molten resin.

The electronic part body used here may be one on which a resin layer is preliminarily formed.

A surface-active agent layer, for example, is used as a layer that changes the surface tension of the resin layer.

A piezoelectric resonator element, for example, is used as the electronic part body.

When the piezoelectric resonator element is used as the electronic part body, it is dipped into a molten resin layer having a surface active agent layer after coating the piezoelectric resonator element with wax.

According to a method of manufacturing an electronic part of the present invention, the surface active agent layer is formed on the surface of the resin in the molten resin bathtub, and the electronic part body is dipped into the molten resin bathtub via the surface active agent layer. Therefore surface tension of the resin layer is improved by the surface active agent. In this way, the surface tension of the resin layer is improved and the resin layer is formed by completely surrounding the entire electronic part body with the molten resin. Consequently, the resin layer is formed on the entire area surrounding the roots of the terminals. As a result, the water tightness of the terminal roots and the resin layer are improved thereby preventing cleaning water from invading into the interior of the electronic part.

When the electronic part body coated with the resin is used, the body is dipped via the surface active agent layer into the molten resin bathtub, so that an outer coat resin layer with a multilayer structure is formed. In this case, the surface tension between the electronic part body and the resin layer is also improved. Then, the final layer of resin can be applied to the electronic part body thereby improving the amount of coverage of the molten resin surrounding the surface of the previously coated resin layer on the electronic part body. Therefore a denser resin layer can be formed.

When a piezoelectric resonator element is used as the electronic part body, both surfaces of a piezoelectric substrate are provided with respective electrodes disposed so as to partially oppose each other, and the electronic part body having the electrodes thus formed is held by a pair of terminals pinching the substrate at both ends and being connected and bonded to the terminals. Then, the opposing electrode surfaces of the electronic part body are coated with wax. Thereafter, the outer coat resin layer is formed by dipping the electronic part body into the molten resin bathtub, with the terminals being held upward.

According to a method of manufacturing an electronic part of the present invention, since the outer coat is formed by dipping the electronic part body into the molten resin bathtub having a surface active agent layer on the surface of the resin, the outer coat can be made with a substantially increased amount of resin coverage. As a result, the outer coat resin layer is formed over the entire surface of the electronic part body surface, thereby strengthening the roots of the terminals and reducing appearance defects and furthermore improving watertightness. In this manner, an electronic part with high reliability can be obtained. In particular, when the outer coat is made by dipping an electronic part already coated with resin into the molten resin bathtub, the roots of the terminals are further strengthened and the appearance defects are reduced. In addition, the watertightness of the electronic part is improved, so that an electronic part with high reliability can be obtained.

The above and further objects, features, aspects and advantages of the invention will more fully be apparent from the following detailed description of embodiments with reference to the accompanying drawings.

DESCRIPTION OF THE PREFERRED EMBODIMENTS

The embodiments of the present invention is explained with reference to the drawings.

Figure 1:
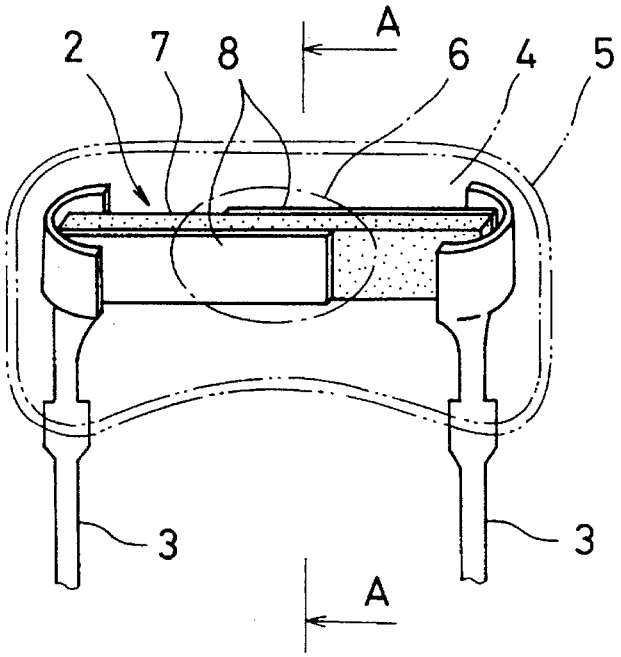
FIG. 1 is a perspective view illustrating an electronic part produced by one embodiment of the present invention.
Figure 2:
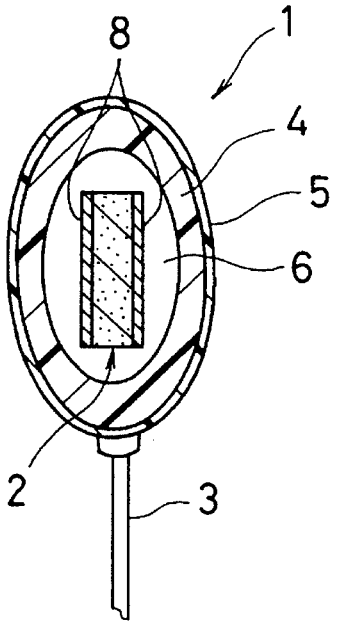
FIG. 2 is a sectional view taken along line A—A of FIG. 1.
Figure 3:
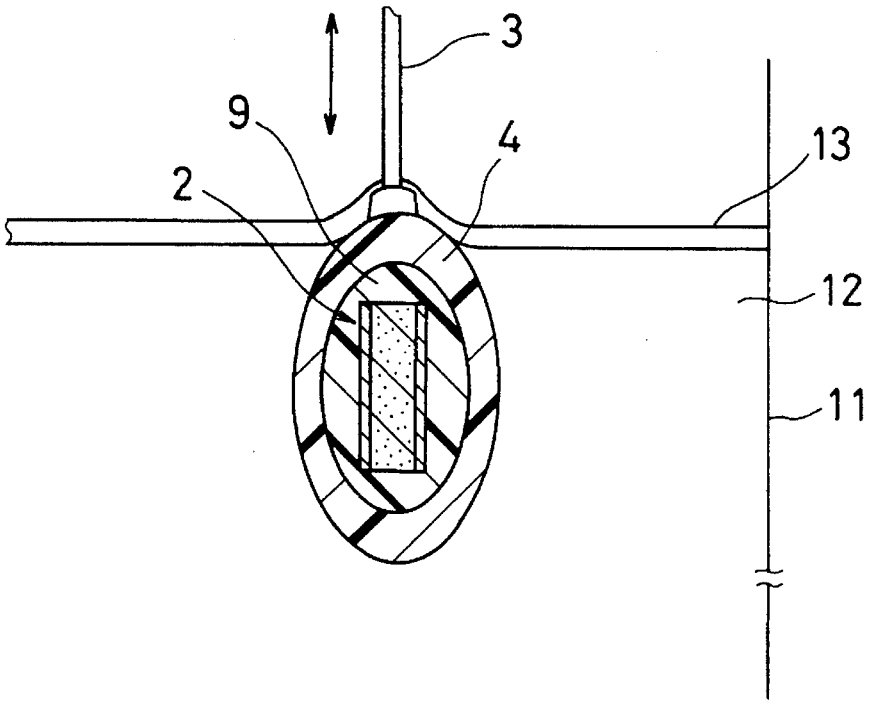
FIG. 3 is a view illustrating a manufacturing process of the embodiment shown in FIG. 1.

FIGS. 1, 2 and 3 are views showing a manufacturing method of an electronic part of one embodiment of the present invention.

Figure 4:
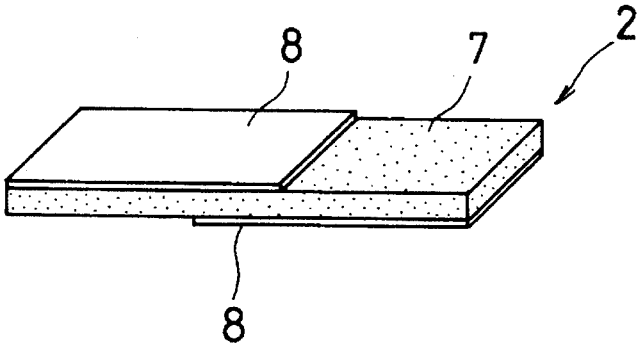
FIG. 4 is a perspective view showing a resonator element.
Figure 5A:
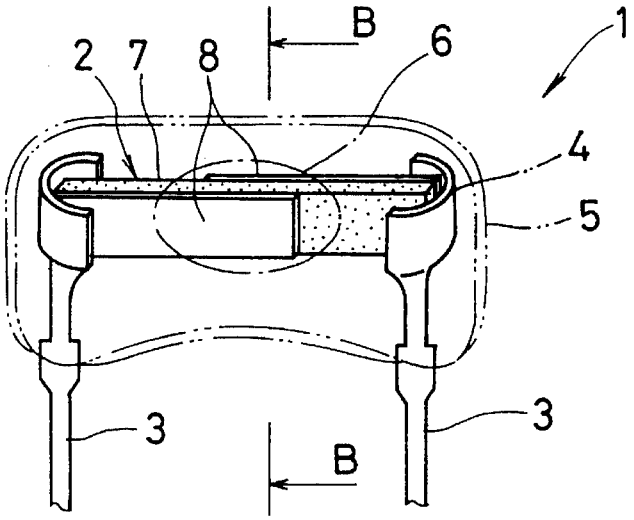
FIG. 5(a) PRIOR ART
FIG. 5(A) and FIG. 5(B) are views showing an electronic part produced by a conventional manufacturing method.
Figure 5B:
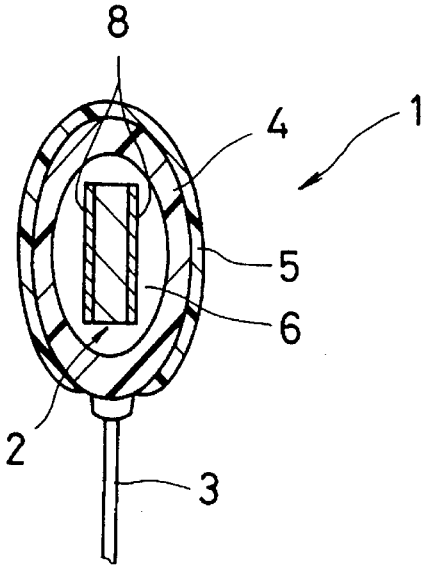
FIG. 5(b) PRIOR ART
Figure 6A:
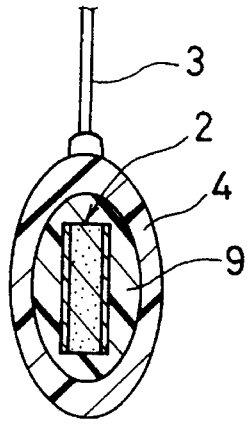
FIG. 6(a) PRIOR ART
FIGS. 6(A), 6(B) and 6(C) are views showing manufacturing processes of an electronic part produced by a conventional manufacturing method.
Figure 6B:
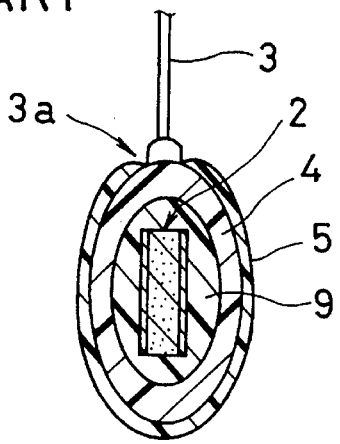
FIG. 6(b) PRIOR ART
Figure 6C:
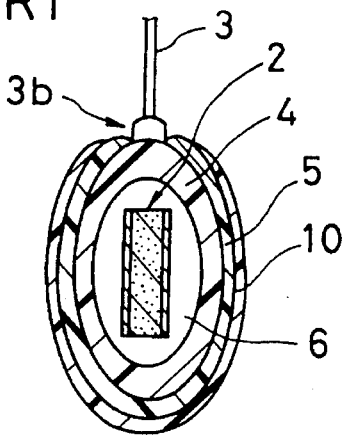
FIG. 6(c) PRIOR ART

Shown in FIGS. 1, 2 and 3 is a piezoelectric resonator 1 produced according to the present embodiment. The piezoelectric resonator 1 is comprised of a strip shaped resonator element 2 that constitutes an electronic part body and as shown in FIG. 4, a pair of terminals 3, 3 that hold the resonator element 2 by pinching it at both ends and are connected to electrodes of the resonator element 2, a first resin layer 4 and a second resin layer 5. To prevent impairing vibration of a vibration electrode portion, a cavity 6 is formed.

In the present embodiment, the first resin layer 4 is made by using thermosetting resin such as epoxy resin which forms a coarse layer that allows the wax on the electrode surfaces to diffuse into the resin. The second resin layer 5 is made by using thermosetting resin which is in composition from the first resin layer 4 and is capable of increasing its own strength and making its surface denser.

A manufacturing method of the electronic part 1 of the present embodiment will now be explained.

The resonator element 2 is held by the pair of terminals 3, 3 and bonded to them while pinching the element at both ends, and the surfaces of the vibration electrodes 8 are coated with wax. The first resin layer 4 is formed in such a manner that the element is dipped into molten resin in a state of holding the terminals 3 with a jig, and coated with the resin leaving the end portions of the terminals 3 uncoated.

As shown in FIG. 3, the resonator element 2 is dipped via a surface active agent layer 13 into a molten resin bathtub 11 in which the surface active agent layer 13 is formed, and is coated with the resin with the surface tension of the first resin layer 4 being reduced. As the surface active agent, for example, acetone, methyl ethyl ketone, or xylene may be used. The second resin layer 5 is formed by pulling up this resonator element 2, and second molten resin 12 sticks on the whole surface of the first resin layer 4.

By heating the first resin layer 4 and the second resin layer 5, the wax on the surfaces of the vibration electrodes 8 is made to melt and diffuse into the first resin layer 4 for sealing. The molten wax is diffused into the resin layer, then the cavity 6 is formed around the surfaces of the oppositely disposed electrodes 8 to prevent impairing vibration of the resonator element 2. The heating may be performed before or after the second resin layer is formed.

Furthermore, if necessary, a coating layer may be formed on the surface of the second resin layer 5 to increase the strength of the layer or to improve the appearances or thereby to protect the surface and to make the surface dense. In addition, the second resin layer 5 may have a multilayer structure.

As mentioned above, according to the present embodiment, the surface active agent layer 13 is formed on the surface of the resin 12 in the second molten resin bathtub 11, and the resonator element 2 is dipped via the surface active agent layer 13 into the bathtub. Accordingly, the surface tension of the first resin layer 4 is reduced and thereafter the element is coated with the second molten resin, so that the second resin layer 5 completely surrounds the entire surface of the first resin layer 4 of the resonator element 2. Thus, the resin layer formed on the element 2 is improved and the thickness of the resin layer can be uniform all over the surface. As a result, an electronic part can be manufactured in which the roots of the terminals 3 are strengthened and the appearance and watertightness are improved.

In addition, in the above embodiment, the outer coat resin layer composed of the two layers is illustrated. However one layer or three or more layers may be used. In this case, the surface active agent layer is formed on a resin surface of a resin bathtub for the first resin layer or the third or more resin layer. The electronic part body is made to be dipped via the surface active agent layer into the resin bath. For the surface active agent, a material which can improve material properties of the resin near the resin surface in the bath and further improve the interfacial force to the element or a prior coated resin layer can be used. For example a material that reduces the surface tension of molten resin or a material that reduces viscosity of the molten resin, may be used even when it is wax. That is, any material that can improve the surrounding ability of the molten resin may be used.

Furthermore, in the above embodiment, a piezoelectric resonator element is used as the electronic part body. However, elements such as a capacitor may be used. For example, in the case of using the capacitor, the cavity for an oscillation space becomes unnecessary, and thus wax coating on the element surface is unnecessary.

Although the present invention has been described and illustrated in detail, it is shown only as the illustrations and as one example, and it is apparently not to be construed that the invention is limited to only the embodiment disclosed, and the spirit and true scope of the present invention is limited only by the appended claims.

What is claimed is:

1. A method of manufacturing an electronic part having an electronic part body, the method comprising the steps of:

(a) preparing a molten resin bathtub including a layer of resin;

(b) forming a layer of a surface active agent on a surface of the layer of resin in the molten resin bathtub such that the layer of the surface active agent remains substantially on top of the layer of resin and is not diluted in the layer of resin in the molten resin bathtub;

(c) dipping the electronic part body into the resin layer in the molten resin bathtub via the layer of surface active agent; and (d) removing the electronic part body from the resin layer in the molten resin bathtub after coating the electronic body with the molten resin.

2. A method of manufacturing an electronic part according to claim 1, wherein the electronic part body includes a resin layer that is formed before dipping the electronic part body into the molten resin bathtub.

3. A method of manufacturing an electronic part according to claim 1, wherein the layer of surface-active agent reduces surface tension of the resin layer in the molten resin bathtub.

4. A method of manufacturing an electronic part according to claim 2, wherein the layer of surface active agent reduces surface tension of the resin layer in the molten resin bathtub.

5. A method of manufacturing an electronic part according to claim 1, wherein the electronic part body is a piezoelectric resonator.

6. A method of manufacturing an electronic part according to claim 2, wherein the electronic part body is a piezoelectric resonator.

7. A method of manufacturing an electronic part according to claim 3, wherein the electronic part body is a piezoelectric resonator.

8. A method of manufacturing an electronic part according to claim 4, wherein the electronic part body is a piezoelectric resonator.

9. A method of manufacturing an electronic part according to claim 5, further comprising a step of coating the piezoelectric resonator with wax before step (b).

10. A method of manufacturing an electronic part according to claim 6, further comprising a step of coating the piezoelectric resonator with wax before step (b).

11. A method of manufacturing an electronic part according to claim 7, further comprising a step of coating the piezoelectric resonator with wax before step (b).

12. A method of manufacturing an electronic part according to claim 8, further comprising a step of coating the piezoelectric resonator with wax before step (b).

* * * * *